US011473596B2

(12) United States Patent
Lind et al.

(10) Patent No.: US 11,473,596 B2
(45) Date of Patent: Oct. 18, 2022

(54) COMBINED SECONDARY INLET BELL AND FLOW GRID FOR A CENTRIFUGAL FAN OR CENTRIFUGAL COMPRESSOR

(71) Applicant: TRANE INTERNATIONAL INC., Davidson, NC (US)

(72) Inventors: Stephen J. Lind, Onalaska, WI (US); Jay E. Grotelueschen, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 267 days.

(21) Appl. No.: 15/665,024

(22) Filed: Jul. 31, 2017

(65) Prior Publication Data

US 2019/0032676 A1 Jan. 31, 2019

(51) Int. Cl.

| | |
|---|---|
| ***F04D 29/66*** | (2006.01) |
| ***F04D 17/08*** | (2006.01) |
| ***F04D 29/44*** | (2006.01) |
| ***F04D 29/42*** | (2006.01) |
| ***F04D 29/70*** | (2006.01) |
| ***F04D 17/16*** | (2006.01) |
| *F04D 29/05* | (2006.01) |

(52) U.S. Cl.

CPC ..... *F04D 29/667* (2013.01); *F04D 17/08* (2013.01); *F04D 17/16* (2013.01); *F04D 29/4213* (2013.01); *F04D 29/441* (2013.01); *F04D 29/663* (2013.01); *F04D 29/668* (2013.01); *F04D 29/703* (2013.01); *F04D 29/05* (2013.01)

(58) Field of Classification Search

CPC ..... F04D 17/08; F04D 17/16; F04D 29/05; F04D 29/4213; F04D 29/441; F04D 29/663; F04D 29/667; F04D 29/668; F04D 29/703; F01D 25/04

See application file for complete search history.

(56) References Cited

U.S. PATENT DOCUMENTS

| | | | | |
|---|---|---|---|---|
| 2,287,822 A * | 6/1942 | Odor | F04D 29/4213 415/185 |
| 5,088,886 A * | 2/1992 | Hopkins | F04D 29/667 415/119 |
| 7,070,385 B2 * | 7/2006 | Milana | F04D 25/14 415/125 |
| 7,677,865 B2 * | 3/2010 | Han | F04D 29/4213 415/119 |

(Continued)

FOREIGN PATENT DOCUMENTS

| | | |
|---|---|---|
| EP | 0926452 | 6/1999 |
| WO | 2014/056657 | 4/2014 |

OTHER PUBLICATIONS

Ebmpapst, "FlowGrid for axial and centrifugal fans", 2015.

*Primary Examiner* — Grant Moubry

(74) *Attorney, Agent, or Firm* — Hamre, Schumann, Mueller & Larson, P.C.

(57) ABSTRACT

A centrifugal fan assembly including fan wheel, a primary inlet bell, a secondary inlet bell, and a flow grid. The primary inlet bell and secondary inlet bell direct air into an inlet of the fan wheel of the centrifugal fan. Also disclosed is a sound reduction assembly for reducing the sound produced by a centrifugal fan or centrifugal compressor. A method of directing air flowing into a centrifugal fan or a centrifugal compressor is also disclosed.

18 Claims, 5 Drawing Sheets

(56) References Cited

U.S. PATENT DOCUMENTS

| | | | | |
|---|---|---|---|---|
| 8,231,334 | B2 * | 7/2012 | Lind | F04D 29/4213 415/119 |
| 2004/0081553 | A1 * | 4/2004 | Milana | F04D 25/14 415/121.2 |
| 2006/0291999 | A1 * | 12/2006 | Han | F04D 29/4213 415/121.2 |
| 2011/0002775 | A1 | 1/2011 | Ma et al. | |
| 2013/0072103 | A1 | 3/2013 | Hopkins et al. | |
| 2014/0209275 | A1 | 7/2014 | Schone et al. | |
| 2015/0211670 | A1 | 7/2015 | Edmonds et al. | |

* cited by examiner

COMBINED SECONDARY INLET BELL AND FLOW GRID FOR A CENTRIFUGAL FAN OR CENTRIFUGAL COMPRESSOR

FIELD

The disclosure relates to features used to reduce the quantity of sound produced by a centrifugal fan or centrifugal compressor used in heating, ventilation, air conditioning, and refrigeration ("HVACR") systems. For example, a centrifugal fan may be an air handler for a HVACR system.

BACKGROUND

Both centrifugal fans and centrifugal compressors have a fan wheel that rotates to discharge air. The centrifugal fan may be, for example, a plenum fan that includes a centrifugal fan or blower with a fan wheel that discharges air to pressurize a cabinet. The plenum fan has an axial opening and radial openings formed between its blades. Air enters the fan wheel through the axial opening and is discharged from fan wheel through the radial openings between its blades.

SUMMARY

Centrifugal fans and centrifugal compressors moves (e.g., sucks, pulls) air in an axial direction and discharge air in a radial direction as their fan blades rotate. A centrifugal fan includes a fan wheel, a primary inlet bell, a secondary inlet bell, a flow grid. The centrifugal fan may be a centrifugal plenum fan that includes a cabinet. The fan wheel has an inlet opening (e.g., an axial opening for incoming air) and radial fan blades. The radial fan blades discharge air in the radial direction when the fan wheel is rotated. The primary bell is in a fixed location relative to the fan wheel and directs air into the inlet opening of the fan wheel. The secondary inlet bell directs the air into the primary inlet bell. The flow grid is attached to the cabinet or the secondary inlet bell and guides the air into the secondary inlet bell. The secondary inlet bell and flow grid synergistically reduce the sound produced by the centrifugal plenum. In particular, the secondary inlet bell and flow grid synergistically reduce the tones (e.g., sounds of a particular frequency) produced by the centrifugal plenum fan.

A centrifugal compressor includes an impeller, an impeller housing, a primary inlet bell, a secondary inlet bell, and a flow grid. The impeller housing has an inlet opening (e.g., an axial opening for incoming air) and a radial outlet. The impeller includes fan blades that discharge air through the radial outlet when the impeller is rotated. The primary bell is in a fixed location relative to the impeller housing and directs airflow into the inlet opening of the impeller housing. The secondary inlet bell directs the air into the primary inlet bell. The flow grid guides the air that flows into the secondary inlet bell. The secondary inlet bell and flow grid synergistically reduce the sound produced by the centrifugal compressor. In particular, the secondary inlet bell and flow grid synergistically reduce the tones (e.g., sounds of a particular frequency) produced by the centrifugal compressor.

In an embodiment, a centrifugal fan assembly includes a fan wheel, primary inlet bell, secondary inlet bell, and a flow grid. The primary inlet bell directs air into an axial inlet (e.g., a fan wheel mouth) of the fan wheel. The fan wheel moves (e.g., sucks, pulls) air through the axial inlet and radially discharges air through one or more radial outlets. The secondary inlet bell directs air into the primary inlet bell. The secondary inlet bell has a shape that minimizes the distance that the air must flow from outside the centrifugal fan assembly to one or more blades of the fan wheel. The flow grid guides the air such that it has a more laminar flow when the air enters the fan wheel.

In an embodiment, a noise reducing assembly reduces the sound produced by a centrifugal fan or a centrifugal compressor. The assembly includes a primary inlet bell and a secondary inlet bell that direct air into an axial inlet of the centrifugal fan or the centrifugal compressor. The primary inlet bell is configured to be in a fixed position relative to either a fan wheel of the centrifugal fan or an impeller housing of the centrifugal compressor. The primary inlet bell has a non-fixed position (e.g., is configured to be independently moveable) relative to the secondary inlet bell. The assembly also includes a flow grid. The flow grid guides the air such that the air flowing into the fan wheel or impeller housing is less turbulent.

In an embodiment, a method of directing air flowing into a centrifugal fan or a centrifugal compressor is described. The method includes positioning a primary inlet bell such that it directs the flow of air into an axial inlet of the centrifugal fan or the centrifugal compressor. The method also includes a secondary inlet bell directing the air flowing into the primary inlet bell. The method further includes a flow grid guiding the air as it flows into secondary inlet bell. The primary inlet bell is configured to be in a fixed position relative to the axial inlet, and the secondary inlet bell is configured to be in a non-fixed position relative to the primary inlet bell.

DESCRIPTION OF THE DRAWINGS

Both described and other features, aspects, and advantages of the centrifugal fan assembly or noise reducing assembly will be better understood with reference to the following drawings.

Like reference numbers represent like parts throughout.

DETAILED DESCRIPTION

A centrifugal fan or centrifugal compressor produces sound during operation. The centrifugal fan or centrifugal compressor produces audible tones (e.g., sound or sounds of a specific frequency) due to periodic airflow into the centrifugal fan or centrifugal compressor. The periodic varying flow of air interacts with the rotating fan blades to create the audible tones. In an embodiment, a larger tone produced by a plenum fan is reduced by including a secondary inlet bell and flow grid.

In an embodiment, a plenum fan includes a primary inlet bell to direct air into a fan wheel. The plenum fan in an embodiment also includes a secondary inlet bell and flow grid. The secondary inlet bell and flow grid synergistically reduce the largest tones produced by the plenum fan. The secondary inlet bell and flow grid help reduce the possible variation of the air into the plenum fan. The reduction of the airflow's variation minimizes and/or prevents a periodic variation of the airflow into the plenum fan. This reduction in the variation (e.g., the periodic variation) reduces the magnitude (e.g., the amount of sound energy) of the tones produced by the plenum fan. Combining the secondary inlet bell with a flow grid synergistically reduces the magnitude of the tones produced by the plenum fan by a greater amount than expected. For example, the secondary inlet bell and flow grid in an embodiment synergistically reduce the largest tone produced by the plenum fan by a greater amount than would be expected. This reduction by the secondary inlet bell and the flow grid is greater than the reductions of either the secondary inlet bell or flow grid individually. Further, the reduction by combining the secondary inlet bell and flow grid is greater than combining the individual reduction effects of the secondary inlet bell and flow grid.

Figure 1:
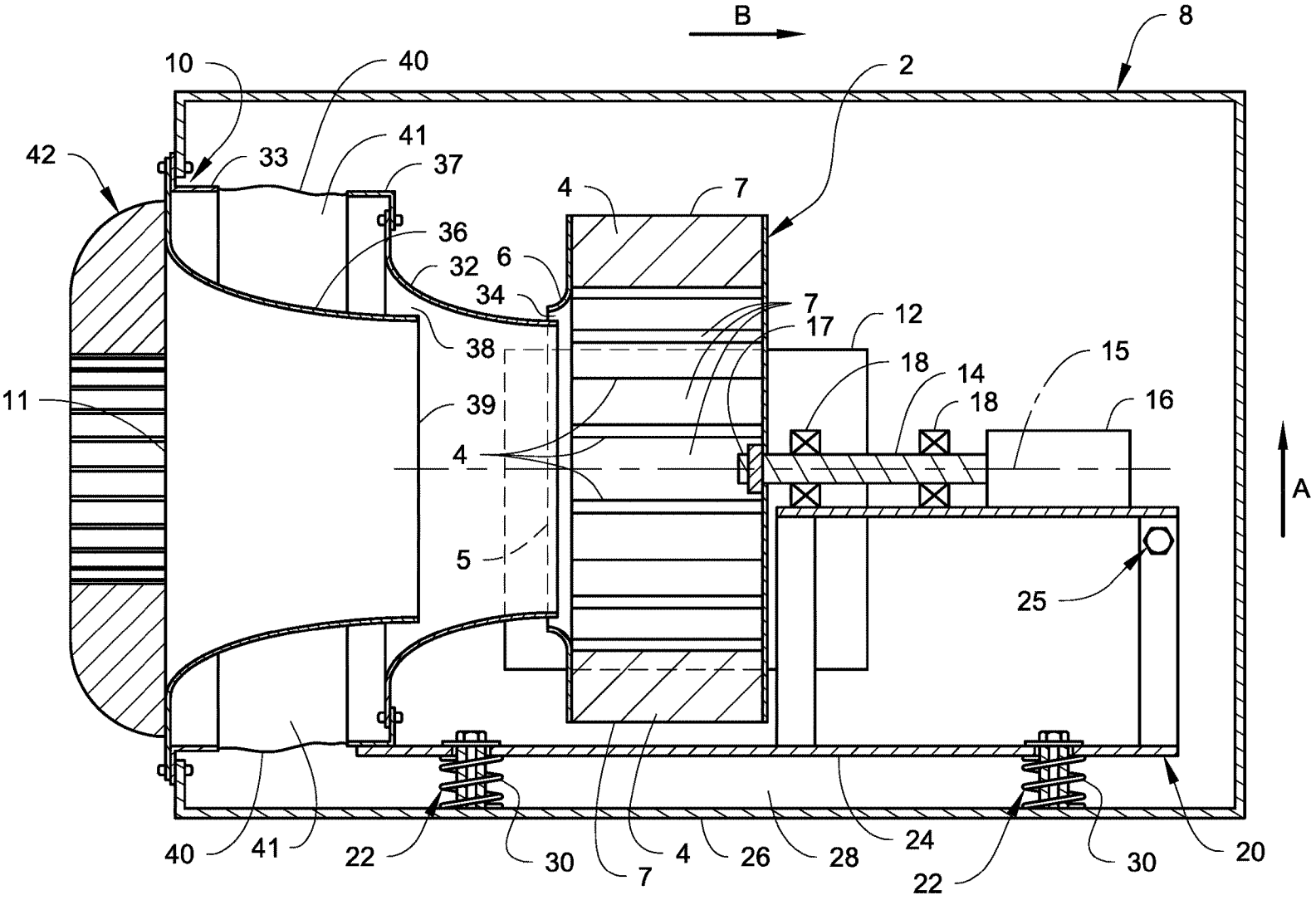
FIG. 1 shows a cross sectional view of an embodiment of a centrifugal plenum fan that includes a secondary inlet bell and a flow grid.

FIG. 1 shows a cross sectional view of a plenum fan in an embodiment. The plenum fan includes a fan wheel 2 having an axial inlet 5 (partially obscured by the primary bell 32 in FIG. 1) and radial outlets 7. The plenum fan includes fan blades 4. The radial outlets 7 are formed in-between the fan blades 4 in an embodiment. The fan wheel 2 has a fan mouth 6 that forms the axial inlet 5 of the plenum fan in an embodiment. A cabinet 8 encloses the plenum fan and directs the air discharged by the fan wheel 2. In an embodiment, the cabinet 8 has a generally cuboid structure (e.g., a rectangular prism) with a rectangular a cross section as shown in FIG. 1. However, the cabinet 8 in an embodiment does not require a specific shape as long as it encloses at least the fan wheel 2 and has at least the features described herein.

The cabinet 8 has two openings: an air inlet 10 and an air outlet 12. However, the cabinet 8 in an embodiment may have one or more air outlets 12. The plenum fan, during operation, moves (e.g., sucks, pulls) air from outside of the cabinet 8 through the air inlet 10 and discharges air out of the cabinet 8 through the air outlet 12.

Applying known principles of plenum fans, the fan blades 4 cause a lower pressure on the outer circumference of the fan wheel 2. This causes the air to be discharged (e.g., flow) outward in the radial direction from the axis 15 of the wheel fan 2. The air outlet 12 of the cabinet 8 then directs the flowing air out of the cabinet 8 from fan wheel 2. The fan blades 4 in an embodiment are located in the outer circumference (e.g., portion of the fan wheel 2 that is farthest from the axis 15) of the fan wheel 2. However, the fan blades 4 may be, for example, affixed (e.g., mounted, attached, fixed) to a central hub 17 of the fan wheel 2 in an embodiment.

The fan wheel 2 is attached to a driveshaft 14 (e.g., crankshaft) such that the rotation of the driveshaft 14 also rotates the fan wheel 2. A motor 16 operates to rotate the driveshaft 14 and the fan wheel 2. In an embodiment, the motor 16 is an electric motor. However, the motor 16 in an embodiment may utilize a different type of motor (e.g., a combustion type motor, an external motor, a motor integral to the wheel) to rotate the driveshaft 14. Two radial bearings 18 rotatably support the driveshaft 14 as shown in FIG. 1. An embodiment may include one or more radial bearings 18 as suitable and/or desired to support the driveshaft 14.

The motor 16 and radial bearings 18 are mounted to a frame 20 in an embodiment. The fan wheel 2 in an embodiment is rotatably affixed (e.g., attached, mounted, fixed) to the frame 20 by the driveshaft 14, the motor 16, and the radial bearings 18. As such, the fan wheel 2 in an embodiment is in a fixed position relative to the frame 20 while still being rotatable.

The frame 20 is separately moveable from the cabinet 8 (e.g., in a non-fixed position relative to the cabinet 8). The frame 20 is attached to the cabinet 8 by one or more vibration isolators 22. The vibration isolators 22 support the frame 20 in the vertical direction (e.g., along direction A) within the cabinet 8. The vibration isolators 22 provide support for the frame 20 while also allowing the frame 20 to be moveable (e.g., in a non-fixed position) relative to the cabinet 8 in the vertical direction (e.g., along direction A).

The fan wheel 2 and/or the motor 16 vibrate during operation of the plenum fan. This vibration is transferred to the frame 20 as both the motor 16 and the fan wheel 2 (via the shaft 14, radial bearings 18, and motor 16) are mounted to the frame 20. However, this vibration is dampened (e.g., reduced) by the vibration isolators 22 so that at least a portion of the vibration is not transferred to the cabinet 8. The frame 20 is supported in the horizontal direction (e.g., a direction perpendicular to direction A and direction B, along the direction C shown in FIG. 2) by a vibration isolator 25 similar to the vibration isolators 22. An embodiment may include one or more vibration isolators 25 to support the frame 20 in the horizontal direction. An embodiment may only include vibration isolators 22 that support the frame 20 in the vertical direction.

As shown in FIG. 1, the vibration isolators 22 are mounted to a bottom panel 26 of the cabinet 8. The vibration isolators 22 support the bottom 24 of the frame 20 such that a space 28 is provided between the bottom 24 of the frame 20 and the bottom panel 26 of the cabinet 8. Each vibration isolator 22 in an embodiment includes a spring 30 that is located between the bottom panel 26 of the cabinet 8 and the bottom 24 of the frame 20. The spring 30 provides a biasing force against the frame 20 in the A direction. In the manner described, the frame 20 is supported within the cabinet 8 such that the vibrational motion of the various components affixed to the frame 20 (e.g., fan wheel 2, motor 16) is not transferred (or is at least dampened) to the cabinet 8. In an embodiment, the vibration isolators 22, 25 may include a different biasing mechanism than the spring 30.

The plenum fan includes a primary inlet bell 32. As shown in FIG. 1, the primary inlet bell 32 has a tapered bell shape with open ends (e.g., similar to a bisected catenoid). In an embodiment, the primary inlet bell 32 may have a different shape than the shape illustrated in FIG. 1. For example, the primary inlet bell 32 in an embodiment may have a shape similar to a cone. The shape of the primary inlet bell 32 allows it to direct flowing air into the axial inlet 5 of the fan wheel 2.

The primary inlet bell 32 is mounted to the frame 20. The primary inlet bell 32 is in a fixed position relative to the fan mouth 6 as both the fan wheel 2 (via the shaft 14, radial bearings 18, and motor 16) and primary inlet bell 32 are affixed to the frame 20. The vibration of the fan wheel 2 is shared by the primary inlet bell 32 as both the fan wheel 2 and the primary inlet bell 32 are affixed to the frame 20. It should be understood that a fixed position relative to the fan mouth 6 may include some minor movement as the vibration of the fan wheel 2 may not perfectly or completely transfer to the frame 20 due to various dampening effects (e.g., materials of the frame and/or driveshaft 14, small amounts of movement allowed by the radial bearings 18).

Air can bypass the fan blades 4 by flowing through an opening 34 between the fan mouth 6 and the primary inlet bell 32. Generally, plenum fans do not want the air that has already been discharged into the pressurized space in the cabinet 8 to flow back into the fan wheel 2. The flow of air through the opening 34 causes an inefficiency of the centrifugal plenum fan. However, the primary inlet bell 32 and the fan mouth 6 in an embodiment have a configuration such that the primary inlet bell 32 and the fan mouth 6 are close together (e.g., the opening 34 is small). The fan mouth 6 and the primary inlet bell 32 are close together because the fan wheel 2 and primary bell 32 are in a fixed position relative to each other. This positioning of the fan mouth 6 and primary inlet bell 34 allows for the space 34 to be minimized. As the opening 34 is minimized (e.g., made smaller), less air is able to travel through the opening 34 and the plenum fan has an improved efficiency.

As shown in FIG. 1, a secondary inlet bell 36 is affixed (e.g., mounted, attached, fixed) to the inlet 10 of the cabinet 8. The secondary inlet bell 36 in an embodiment is bell shaped with open ends (e.g., similar to a bisected catenoid). The secondary inlet bell 36 has a mouth 11. In an embodiment, the secondary inlet bell 36 is affixed within and/or over the air inlet 10 of the cabinet 8. Air flows into the cabinet 8 by way of the mouth 11 of the secondary inlet bell 36 in the embodiment shown in FIG. 1.

The secondary inlet bell 36 and primary inlet bell 32 direct the air from outside of the cabinet 8 towards the axial inlet 5 (e.g. fan mouth 6) of the fan wheel 2. The shape of the secondary inlet bell 36 has few to no irregularities along the flow path of the air. For example, an irregularity would be the corners of an inlet of a cabinet that was square. The shape of the secondary inlet bell 36 promotes a more laminar flow of air into the primary inlet bell 32 and the fan wheel 2. The secondary inlet bell 36 is shaped so that the distance traveled from outside the cabinet 8 (e.g., from the mouth 11 of the secondary inlet bell 32, from the air inlet 10 of the cabinet 8) to the fan blades 2 is more even around the circumference air inlet 10. Minimizing the variance in the distance the incoming air travels reduces the magnitude of the sound (e.g., tones) produced by the centrifugal plenum fan.

As shown in FIG. 1, an outlet 39 of the secondary inlet bell 36 protrudes partly into the primary inlet bell 32. A clearance space 38 is located between the surfaces of the secondary inlet bell 36 and the primary inlet bell 32. The clearance space 38 is a radial gap between the surfaces of the secondary inlet bell 36 and the primary inlet bell 32. The secondary inlet bell 36 and primary inlet bell 32 are positioned such that the clearance space 38 is minimized. However, the clearance space 38 is also adequately sized to allow some movement of the primary inlet bell 32 (relative to the secondary inlet bell 36). The size of the clearance space 38 in an embodiment is large enough to account for the movement of the primary inlet bell 32 due to its possible vibration. The clearance space 38 is large enough so that the primary inlet bell 32 and secondary inlet bell 36 do not contact if the primary inlet bell 32 moves due its vibration. Air would flow into the primary inlet bell 32 through the space 38. This air is air that has already been discharged by the fan wheel 2. As such, allowing airflow through the clearance space 38 would lead to a lower efficiency of the centrifugal plenum fan as the plenum fan would be re-blowing air from the pressurized space inside the cabinet 8.

The centrifugal plenum fan in an embodiment includes a flexible duct 40 that is configured to prevent air from flowing through the clearance space 38 between the primary inlet bell 32 and the secondary inlet bell 36. In particular, the flexible duct 40 is configured to prevent air from flowing around the fan wheel 4 or air that has already been discharged by the fan wheel 4 from reentering the fan wheel 4 via the primary inlet bell 32 and clearance space 38. Accordingly, the flexible duct 40 in an embodiment is configured to prevent airflow between the primary inlet bell 32 and the secondary inlet bell in the radial direction (e.g., along direction A).

The flexible duct 40 includes a first bracket 33 and a second bracket 37. The flexible duct 40 is affixed (e.g. attached, mounted, fixed) to first bracket 33 and the second bracket 37. The first bracket is affixed to the cabinet 8 and the second bracket 37 is affixed to the secondary inlet bell 36. However, in an embodiment, the flexible duct 40 may not include the first bracket 33 and second bracket 37. In an embodiment, the flexible duct 40 may be directly affixed to the secondary inlet bell 36 and/or the cabinet 8 without the first bracket 33. As shown in FIG. 1, the second bracket 37 is affixed to the frame 20 and the primary inlet bell 32. However, in an embodiment, the second bracket 37 may be directly fixed to either the frame 20 or the primary inlet bell 32. In an embodiment, the flexible duct 40 may be directly affixed to the frame 20 and/or the primary inlet bell 32 without the second bracket 37.

The flexible duct 40 creates a partially enclosed volume 41 between the primary inlet bell 32 and the secondary inlet bell 36. The partially enclosed volume 41 in an embodiment is configured such that the clearance space 38 is the only opening into the partially enclosed volume 41. The flexible duct 40 and the partially enclosed volume 41 prevent air from flowing around or re-entering the fan wheel 2 via the clearance space 38. As the partially enclosed volume 41 does not have another opening (e.g., an exit), air does not flow through the clearance space 38 and the partially enclosed volume 41. In such a manner, the flexible duct 40 provides a flexible seal between the primary inlet bell 32 and secondary inlet bell 36. In an embodiment, the flexible duct 40 may be a seal that is disposed between the primary inlet bell 32 and the secondary inlet bell. The seal is configured so that it blocks air while not transferring a portion of the vibration. For example, the flexible duct 40 may be a foam gasket in an embodiment.

The flexible duct 40 is constructed so that it bends and easily moves in the radial direction (e.g., direction A, direction C shown in FIG. 2) and the axial direction (e.g., direction B) while its ends stay affixed. The flexible duct 40 bends with the primary inlet bell 32 as it moves relative to the cabinet 8 and the secondary inlet bell 36. The flexible duct 40 reduces the amount of the vibration (e.g., the radial and/or axial movement) that is transferred from the primary inlet bell 32 to the cabinet 8 and/or secondary inlet bell 36 as the flexible duct 40 bends to accommodate the movement of the primary inlet bell 32.

In the manner described above, air is directed into the fan wheel 2 by the inlet bells 32, 36 while the vibrational movement of the fan wheel 2, the motor 16, the frame 20, and the primary inlet bell 32 is not transferred to the cabinet 8. In an embodiment, the flexible duct 40 and vibration isolators 22, 25 may reduce the vibration (e.g., movement) of the primary inlet bell 32 and/or frame 20 that is transferred to the cabinet 8 instead of preventing the transfer of all vibration.

As shown in FIG. 1, a flow grid 42 is affixed (e.g. mounted, attached, fixed) to the secondary inlet bell 36. In an embodiment, the flow grid 42 may be affixed to the cabinet 8 or the primary inlet bell 32. As the flow grid 42 can cause small trailing eddies, it can be beneficial to affix the flow grid 42 in a position that is farther away from the fan wheel 2. The flow grid 42 guides (e.g., directs in a particular manner) the air flowing into cabinet 8 and the secondary inlet bell 10. A turbulent flow (e.g., flow without swirling and/or eddies) of air into the fan wheel 2 can interact with the blades 4 and create periodic pressure pulses with harmonics, which can be perceived as loud tones. The flow grid 42 guides the air into the secondary inlet bell 36 so that the flow of air is more even or laminar. The flow grid 42 guides the air by limiting the radial and circumferential movement of the air as it flows past the flow grid 42. For example, limiting the radial and circumferential movement of the air helps prevent swirling and eddy formation. The air then enters the fan wheel 2 as a laminar flow. The flow grid 42 in an embodiment has a concave shape facing towards the cabinet 8. The flow grid 42 in an embodiment may have a non-concave shape (e.g., planar shape). A flow grid with a concave shape may be advantageous as it produces a more laminar flow than a non-concave shape.

Figure 2:
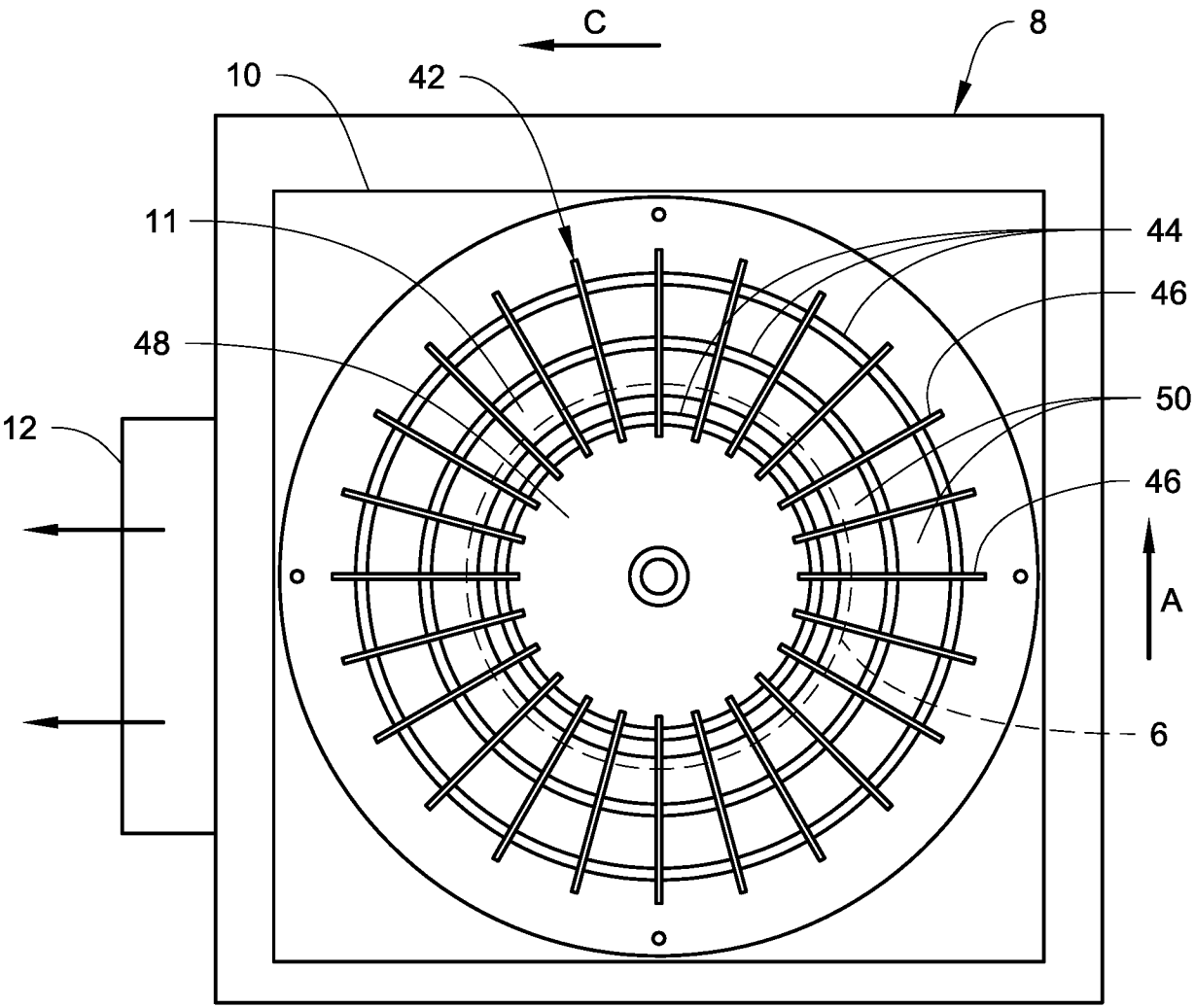
FIG. 2 shows a schematic view of the front of a cabinet of a centrifugal plenum fan in an embodiment.

FIG. 2 is a schematic diagram of a front of the air inlet 10 (e.g., from direction B) of the cabinet 8. The secondary inlet bell 36 (as shown in FIG. 1) is mounted around the air inlet 10 of the cabinet 8. Air is moved (e.g., sucked, pulled) into the cabinet 8 through the mouth 11 of the secondary inlet bell 36 (show in FIG. 1). Air is then discharged from the cabinet 8 through the air outlet 12 of the cabinet 8. In an embodiment, the air outlet 12 may be located in a different location (e.g., a different side of the cabinet 8). In an embodiment, the cabinet 8 may include two or more air outlets 12.

The flow grid 42 guides the air as it enters the cabinet 8. The flow grid 42 guides the air so that the air enters the secondary inlet bell 36 (shown in FIG. 1) with limited circumferential and radial air movement. For example, a non-turbulent flow of air has little to no swirling and eddy formation. Thus, the air enters the fan wheel 2 (shown in FIG. 1) in a more laminar flow. The fan mouth 6 is shown in FIG. 2 for illustration purposes. However, the fan mouth 6 would be blocked by the primary inlet bell 32 in a front view of the cabinet 8 in an embodiment.

The flow grid 42 in an embodiment includes individual concentric rings 44 and radial dividers 46. The concentric rings 44 and radial dividers 46 form separated volumes 50. A portion of the incoming air flows through separated volumes 50. Each separated volume 50 guides air towards the fan wheel 2 (shown in FIG. 1) (e.g., in direction B in FIG. 1). The separated volumes 50 reduce the radial and circumferential movement of the air as it enters the cabinet 8. The reduction of the radial and circumferential movement of the flowing air helps prevent the flowing air from swirling or forming eddies, which contribute to producing a more turbulent flow.

The flow grid 42 in an embodiment may include other shapes as suitable and/or desired to prevent the turbulent flow of air into the cabinet 8. For example, the flow grid 42 in an embodiment may include one or more concentric rings 44 and one or more radial dividers 46. The flow grid 42 includes a middle opening 48. However, a flow grid 42 in an embodiment may not include the middle opening 48 (e.g., the separated volumes cover the entire mouth 11 of the secondary inlet bell 36).

Figure 3:
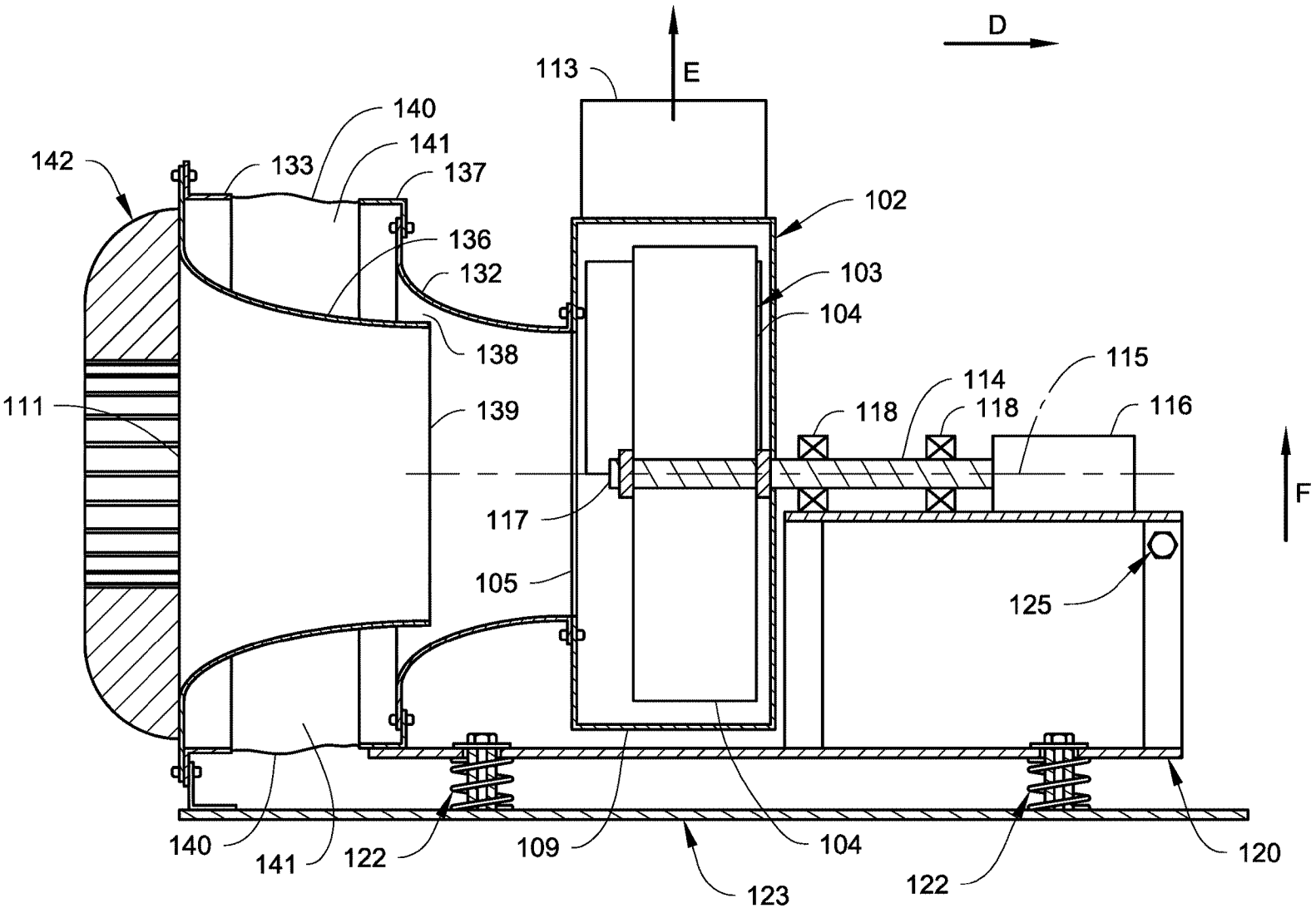
FIG. 3 shows a cross sectional view of a centrifugal compressor in an embodiment.
Figure 4:
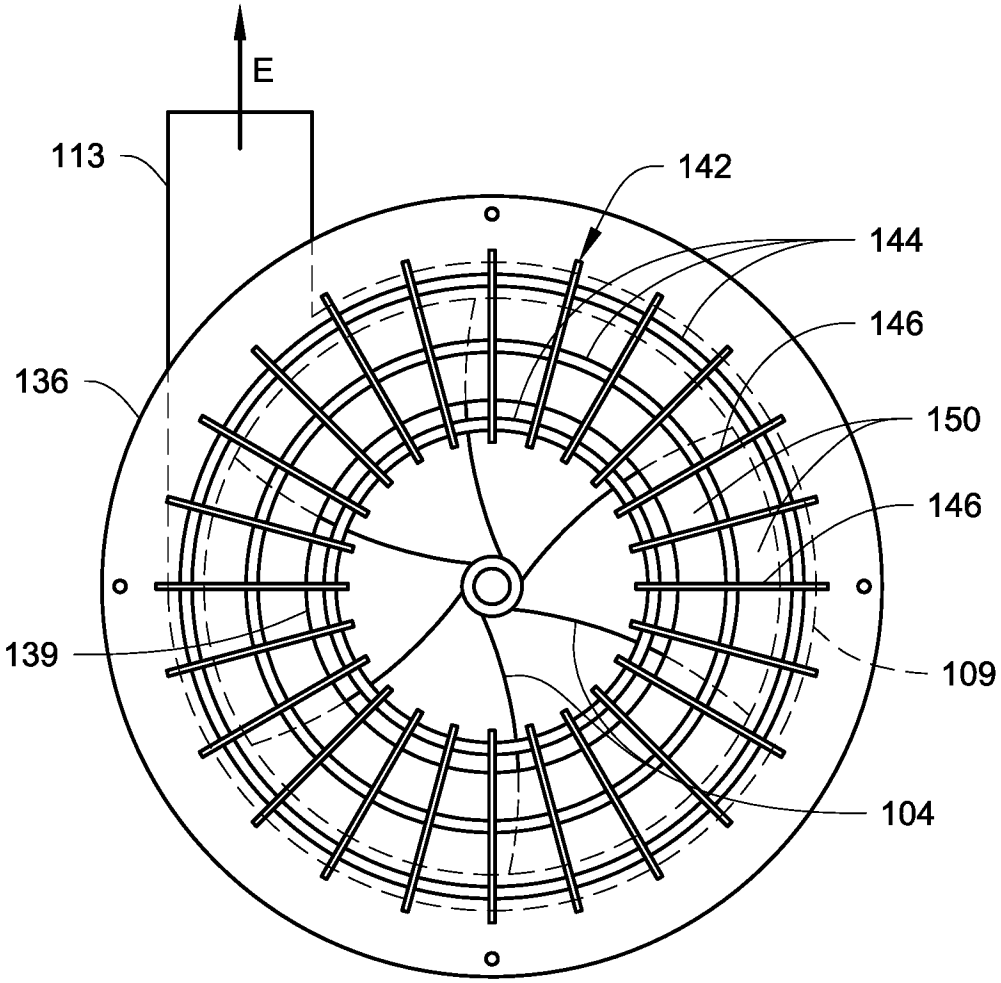
FIG. 4 shows a schematic view of the front of a centrifugal compressor in an embodiment.

FIG. 3 shows cross sectional view of a centrifugal compressor in an embodiment. FIG. 4 shows schematic view of the front of the centrifugal compressor of FIG. 3 in an embodiment. As shown in FIG. 3, the centrifugal compressor includes an impeller housing 102 and an impeller 103 located in the impeller housing 102. The impeller 103 has blades 104 and a central hub 117. The impeller housing 102 includes an axial inlet 105 and a radial outlet 113. During operation, air enters the impeller housing 102 through the axial inlet 105 in an axial direction (e.g., direction D) and exits the impeller housing 102 through the radial outlet 113 as shown by the arrow E.

As shown in FIG. 4, the radial outlet 113 in an embodiment protrudes from an outer circumference portion 109 of the impeller housing 102. The outer circumference portion 109 is shown in dashed lines as the impeller housing 102 is obscured by the primary inlet bell 132 and the secondary inlet bell 136 in an embodiment. However, the primary inlet bell 132 and/or secondary inlet bell 136 may be smaller or larger as suitable or desired to provide adequate airflow for the centrifugal compressor. For example, the primary inlet bell 132 and secondary inlet bell 136 in an embodiment may be constructed to have a size that is based on the size of the axial inlet 105.

In an embodiment, the impeller 103 includes curved blades 104 as shown in FIG. 4. During operation, the curved blades 104 are rotated in a clockwise direction such that the air is directed towards the radial outlet 113. However, the impeller 103 may be constructed to include straight blades 104 or other features (e.g., blades 104 having curves along the axial direction) as is suitable or desirable to improve the function and/or efficiency of the centrifugal compressor. For example, in an embodiment, the impeller 114 may include a baseplate (not shown) that extends radially extends from the central hub 117 and supports the blades 104.

Applying known principles of centrifugal compressors, the blades 104 pushes air in a radial direction of the impeller 103 towards the outer circumference of the impeller housing 102. This causes the air to be discharged (e.g., flow) outward in the radial direction from the axis 115 of the impeller 103. The rotation of the impeller 103 and its blades 104 is great enough that the air is compressed before being discharged in an embodiment. The radial outlet 113 provides an outlet for the air as it is in pushed radially outward. The primary inlet bell 132 and secondary inlet bell 136 direct air into the axial inlet 105 in a similar manner to the primary inlet bell 32, secondary inlet bell 36, and axial inlet 5 as discussed above. In particular, during operation, air enters through the mouth 111 of the secondary inlet bell 136, through the primary inlet bell 132, and then into impeller housing 102 via its axial inlet 105.

The impeller 103 is rotatably affixed (e.g., mounted, attached, fixed) to a driveshaft 114 (e.g., crankshaft) that is rotated by a motor 116. The motor 116 rotates the impeller 103 via the driveshaft 114. The motor 116 is an electric motor. However, the motor 116 in an embodiment may utilize a different type of motor (e.g., combustion type motor) to rotate the driveshaft 114. The driveshaft 114 is supported in the radial direction by two radial bearings 118. In an embodiment, the driveshaft 114 may be supported by one or more radial bearings 118 as suitable and/or desired to support the driveshaft 114.

The radial bearings 118 and motor 116 are affixed (e.g., mounted, attached, fixed) to a frame 120 in an embodiment. The secondary inlet bell 136 is affixed to a first bracket 133 and the primary inlet bell 132 is affixed to a second bracket 137. As shown in FIG. 3, the primary inlet bell 132 is affixed to the frame 120 via a second bracket 137. However, the primary inlet bell 132 may be directly affixed to the frame 120 without the secondary bracket 137 in an embodiment. Accordingly, the impeller housing 102 is affixed to the frame 120 via the primary inlet bell 132, the driveshaft 114, the radial bearings 118, and the motor 116. However, it should be appreciated that an embodiment may include one or more supporting members (not shown) that are directly affixed to impeller housing 102 and the frame 120. The supporting member(s) may directly support the impeller housing 102 on the frame 120.

The frame 120 is supported on a supporting frame 123 by vibration isolators 122. The supporting frame 123 is not particularly limited. For example, the supporting frame 123 may be a concreate pad or other structure that supports the centrifugal compressor. The vibration isolators 122 in an embodiment may perform in a similar manner to the vibration isolators 22 described above and support the frame 120 on the support structure 123 in the vertical direction (e.g., along the direction F). Vibration isolators 125 are also included to support the frame 120 in the horizontal direction in an embodiment. The ends of the vibration isolators 125 not attached to the frame 120 may be, for example, affixed to a separate support beam (not shown) that extends in the vertical direction (e.g., direction F) and is affixed to the support structure 123. In an embodiment, the centrifugal compressor may include one or more vibration isolators 122,125. In an embodiment, the centrifugal compressor may only include vibration isolators 122 to support the frame 120 in the vertical direction.

The impeller 103, impeller housing 102, and motor 116 vibrate during operation of the centrifugal compressor. However, a reduced amount (e.g., percentage) of this vibration is transferred to the to the supporting frame 123 as the frame 120, which supports the impeller 103, impeller housing 102, and motor 116, is supported by the one or more vibration isolators 122, 125. The vibration isolators 122, 125 support the frame 120 in a similar manner to the vibration isolators 22, 25 and frame 20 as discussed above.

As similarly discussed above regarding the primary inlet bell 36 in FIG. 1, the secondary inlet bell 136 is shaped so that the length traveled from the mouth 111 of the secondary inlet bell 136 to the blades 104 is more even around the circumference of the mouth 111. This minimizes the variance in the distance that the incoming air travels between the air inlet (e.g., the mouth 111 of the secondary inlet bell 136) and the blades 104 around the circumference of the air inlet. Minimizing the variance in the distance the incoming air travels reduces the magnitude of the sounds (e.g., tones) produced by the blades 104.

As shown in FIG. 3, the secondary inlet bell 136 is positioned such that its outlet 139 is positioned within the primary inlet bell 132. A clearance space 138, similar to the clearance space 38 in FIG. 1, is formed between the surfaces of the secondary inlet bell 136 and the primary inlet bell 132. The size of the clearance space 138 in an embodiment is large enough to account for the movement of the primary inlet bell 132 (relative to the secondary inlet bell 136) due to its possible vibration. The clearance space 138 being large enough so that the primary inlet bell 132 and secondary inlet bell 136 do not contact if the primary inlet bell 132 moves due its vibration. Air flowing through the clearance space 138 travels a different distance then the air traveling from the mouth 111 of the secondary inlet bell 136. This variance distance traveled by the air can interact with the rotating blades 104 produce large sounds (e.g. tones) as discussed above. Air flowing through the clearance space 138 can also create more turbulent flow into the impeller housing 102, which can increase the magnitude of the sounds (e.g., tones) created by the blades 104.

A flexible duct 140 is provided between the secondary inlet bell 136 and primary inlet bell 140 in an embodiment. The flexible duct 140 affixed to the secondary inlet bell 136 via the first bracket 133 and a primary inlet bell 132 via the second bracket 137. However, in an embodiment the flexible duct 140 may be directly affixed to the primary inlet bell 132, the secondary inlet bell 136, and/or the frame 120. In a similar manner to the flexible duct 40 in FIG. 1, the flexible duct 140 forms a partially enclosed space 141 between the primary inlet bell 132 and the secondary inlet bell 136. The partially enclosed space 141 prevents air from flowing through the clearance space 138. In particular, the flexible duct 140 helps prevent air from flowing in the radial direction between the primary inlet bell 132 and secondary inlet bell 136. The flexible duct 140 may be constructed in a similar manner to the flexible duct 40. The flexible duct 140 may bend with the movement of the secondary inlet bell 136 to reduce the amount of the vibration that is transferred to the secondary inlet bell 136 and/or supporting frame 123.

In the manner described above, air is directed into the impeller housing 102 by the inlet bells 132, 136 while a reduced amount of the vibrational movement of the impeller 103 and/or motor 116 is transferred to the supporting frame 123. In an embodiment, the flexible duct 140 and vibration isolators 122, 125 may reduce the vibration (e.g., movement) of the primary inlet bell 132 and frame 120 that is transferred to the supporting frame 123.

As shown in FIGS. 3 and 4, a flow grid 142 is affixed to the secondary inlet bell 136. The flow grid 142 guides (e.g., directs in a particular manner) the air as it flows into the secondary inlet bell 136. The flow grid 142 guides the air so as to limit the circumferential and radial movement of the air. Thus, the air has a more laminar flow (e.g., non-turbulent flow, a flow with limited or no swirling and eddy formation) as it enters the impeller housing 102 and encounters the blades 104. In an embodiment, the flow grid 142 may be directly affixed to the primary inlet bell 132.

The flow grid 142 may be similarly constructed to the flow grid 42 described above. The flow grid 142 may include one or more radial dividers 146 and two or more concentric rings 144. The radial dividers 146 and concentric rings 144 form separated volumes 150. The separated volumes 150 limit the radial and the circumferential movement of the air as it flows into the secondary inlet bell 136.

The flow grid 142 in an embodiment may include other shapes as suitable and/or desired to prevent the turbulent flow of air into the secondary inlet bell 136. The secondary inlet bell 136 is shown as circular in FIG. 4. However, the secondary inlet bell 136 may be other shapes with a circular or mostly circular mouth 111 in an embodiment.

An embodiment of a method for directing air into a centrifugal fan or centrifugal compressor may also be described. The method includes configuring and/or positioning a primary inlet bell 32, 132, a secondary inlet bell 36, 136, and a flow grid 42, 142 such that they direct air into a fan wheel 2 or an impeller housing 102. The primary inlet bell 32, 132, secondary inlet bell 36, 136, and flow grid 42, 142 being configured so as to reduce the tones produced by the fan blades 4, 104. A primary inlet bell 32, 132 is positioned in a non-fixed position relative to the axial inlet 5, 105. The secondary inlet bell 32, 132 is configured and/or positioned such it directs the air into the primary inlet bell 32, 132. The secondary inlet bell 36, 136 is configured to be in non-fixed position relative to the primary inlet bell 32, 132 as discussed herein. The flow grid 42, 142 is configured and/or positioned to guide the air flowing into the primary inlet bell 132 so as to prevent and/or reduce turbulent flow of air into the fan wheel 2 or impeller housing 102. The flow grid 42, 142 promotes a more laminar flow into the secondary inlet bell 36, 136.

Centrifugal plenum fans and centrifugal compressors produce harmonic tones (e.g., sounds) during their operation. In an embodiment, the flow grid 42 and the secondary inlet bell 36 are added to reduce (e.g., dampen) the magnitude of the harmonic tones produced by the centrifugal plenum fan. In an embodiment, the flow grid 142 and the secondary inlet bell 136 are added to reduce (e.g., dampen) the magnitude of the harmonic tones produced by the centrifugal compressor.

The sound produced from a variety of plenum fans configurations, each including a centrifugal fan, was recorded. The sound produced by each centrifugal plenum fan was analyzed by frequency. The sound was analyzed by utilizing standardized one-third-octave bands following known principles of sound analysis. Each one-third-octave band includes a set range of frequencies and has a label that is near the midpoint of its range of frequencies. For example, sound when analyzed using one-third-octave bands includes the 200 hertz centered band that includes the frequencies between 178 hertz and 224 hertz. For example, the 200 hertz centered band is calculated by logarithmically adding the energy that occurs at the frequencies between 178 hertz and 224 hertz.

Figure 5:
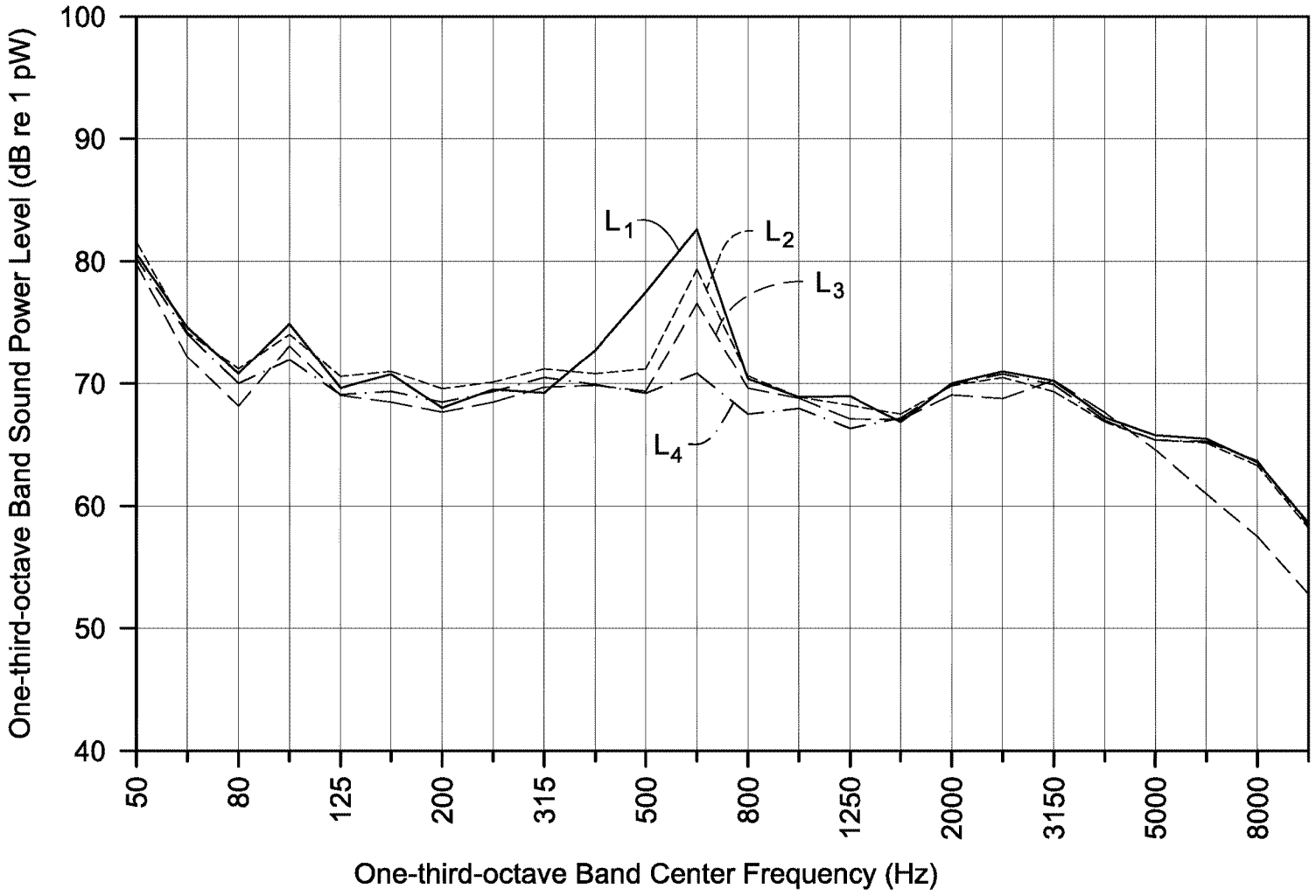
FIG. 5 is a graph of one-third-octave bands of sound power levels produced by various plenum fan configurations.

The graph of FIG. 5 includes sound measurements for multiple plenum fan configurations. Each plenum fan includes a centrifugal fan. Four plenum fan configurations are included in the graph of FIG. 5. Each line represents the sound produced by a plenum fan with a different configuration. The sound produced by the plenum fan as shown in FIG. 1 and described above is represented by the line $L_4$. The line $L_4$ represents the sound produced by an embodiment of a centrifugal plenum fan including the secondary inlet bell 36 and the flow grid 42. Line $L_1$ represents the sound produced by a centrifugal plenum fan that does not have the secondary inlet bell 36 or the flow grid 42. The Line $L_2$ represents the sound produced by a centrifugal plenum fan having the secondary bell inlet 36 but without the flow grid 42. Line $L_3$ represents the sound produced by a plenum fan with the flow grid 42 but without the secondary inlet bell 36.

The x-axis of the graph of FIG. 5 is the one-third-octave bands as labeled by their center frequency in hertz. Each one-third-octave band logarithmically adds the amount of sound energy that occurs within the range of frequencies of the specified band as described above. The Y-axis is the average sound power level of the sound produced within each one-third-octave band frequency by a plenum fan.

The sound power level for each band frequency is expressed in decibels (dB) re picowatt (pW). Decibels re 1 picowatt (dB re pW) is a logarithmic scale that relates a magnitude of the sound produced (P) (e.g., the quantity of sound produced by a plenum fan) to the magnitude of a reference sound ($P_o$). The reference sound ($P_o$) in the graph of FIG. 5 has a power of 1 picowatt (pW).

As shown in FIG. 5, a plenum fan produces the largest amount of sound (e.g., the tones with the largest sound power) in a one-third-octave centered band of 630 hertz. In an embodiment, a centrifugal fan or centrifugal compressor may produce the largest amount of sound in a one-third-octave centered band that is different than 630 hertz. In an embodiment, the size of the partially enclosed volume 41, 141 can determine the effect (e.g., the reduction of sound) of the secondary inlet bell 36, 136 on particular tones (e.g., a sound with a particular frequency). For example, the size of the partially enclosed volume 41, 141 may determine the effect that the secondary inlet bell 36, 136 has on a particular tone. The size of the partially enclosed volume 41, 141 depends upon the relative positioning of the primary inlet bell 32, 132 and the secondary inlet bell 36, 136. In an embodiment, the primary inlet bell 32, 132 and secondary inlet bell 36, 136 may be positioned so as to maximize secondary inlet bell's 36, 136 reduction of the largest tone produced by the centrifugal fan or centrifugal compressor.

A plenum fan without a secondary bell 36 or flow grid 42 is represented by the line $L_1$. The plenum fan without a secondary bell 36 or flow grid 42 produced an average of approximately 82.7 dB re pW of sound within the 630 hertz centered band.

A plenum fan including only the secondary inlet bell 36 is represented by the line $L_2$ in the graph of FIG. 5. The plenum fan including only the secondary inlet bell 36 produced an average of approximately 79.5 dB re pW of sound within the 630 hertz centered band. The secondary inlet bell 36 (without the flow grid 42) reduced the average amount of sound produced by the plenum fan within the 630 hertz centered ban by approximately 3.83% (or approximately 3.17 dB re pW).

A plenum fan including only the flow grid 42 is represented by the line $L_3$ in the graph of FIG. 5. The plenum fan including only the flow grid 42 produced an average of 76.8 dB re pW of sound within the 630 hertz centered band. The flow grid 42 (without the secondary inlet bell 36) reduced the average amount of sound produced by the plenum fan within the 630 hertz centered ban by approximately 5.80 dB re pW (or approximately 7.02%).

An embodiment of the centrifugal plenum fan (e.g., the centrifugal plenum fan shown in FIG. 1) that includes the flow grid 42 and the secondary inlet bell 36 is represented by the line $L_4$ in the graph of FIG. 5. The plenum fan including the secondary inlet bell 36 and flow grid 42 produced an average of approximately 70.9 dB re pW of sound within the 630 hertz centered band. The secondary inlet bell 36 and flow grid 42 reduced the average amount of sound produced by the plenum fan within the 630 hertz centered band by approximately 11.7 dB re pW (or approximately 14.2%).

The flow grid 42 and secondary inlet bell 36 in combination provide a greater sound reduction (a reduction of approximately 11.7 dB re pW or 14.2%) of the largest tones (e.g., the sounds produced in the one-third octave centered band of 630 hertz) than either the secondary inlet bell 36 (a reduction of approximately 3.17 dB re pW or 3.83%) or the flow grid 42 (a reduction of approximately 5.80 dB re pW or 7.02%). The flow grid 42 and secondary inlet bell 36 also synergistically reduce the magnitude of the largest tones (e.g., the sound within the frequencies of the 630 hertz centered band) produced by the plenum fan. The flow grid 42 and secondary inlet bell 36 have synergy as they provide a greater sound reduction than expected. For example, in an embodiment, the secondary inlet bell 36 and the inlet flow grid 42 have synergy as the combination reduces the magnitude of the largest tone by a greater amount (approximately 11.7 dB or 14.2%) than is expected (approximately 8.75 dB or 10.6%, as described below) by combining the individual effects of the secondary inlet bell 36 and flow grid 42.

The expected effect of combining the individual effects of the secondary inlet bell 36 and flow grid 42 may be calculated by modifying the plenum fan including only a secondary inlet bell 36 (e.g., plenum fan represented by the line $L_2$) with the effect (e.g., reduction) of the flow grid 42. Alternatively, the expected effect of combining the individual effects may be calculated by modifying the plenum fan including only the flow grid 42 (e.g., plenum fan represented by the line $L_3$) with the effect (e.g., reduction) of the secondary inlet bell 36.

The sound produced by the plenum fan having a secondary inlet bell 36 (represented by the line $L_2$) may be modified to include the effect of the flow grid 42. The effect (e.g., the sound reduction) of the flow grid 42 is demonstrated by the plenum fan only including the secondary inlet bell 36 (e.g., the plenum fan represented by the line $L_3$). An expected level of sound is calculated by reducing the magnitude of the sound produced by the plenum fan having only a secondary bell 36 within the 630 hertz centered band (approximately 79.47 dB re pW) by the effect of the flow grid 42 (e.g., a reduction of approximately 7.02%). Thus, the expected sound of the modified plenum fan is approximately 73.9 dB re pW in the 630 hertz centered band. 73.9 dB re pW is approximately an 8.75% reduction of the original sound (e.g., the sound produced by the plenum fan without a second inlet bell 36 or the flow grid 42, which is represented by the line $L_1$) produced by the plenum fan in the 630 hertz centered band.

Alternatively, the sound produced by the plenum fan having only a flow grid 42 (represented by the line $L_3$) may be modified to include the effect of the secondary inlet bell 36. The effect (e.g., the sound reduction) of the secondary inlet bell 36 is demonstrated by the plenum fan only including the secondary inlet bell 36 (represented by the line $L_2$). An expected magnitude of sound is calculated by reducing the sound produced by the plenum fan having only a flow grid 42 within the 630 hertz centered ban (approximately 76.83 dB re pW) by the effect of the secondary inlet bell 36 (e.g., a reduction of approximately 3.17%). The expected sound of the modified plenum fan is approximately 73.9 dB re pW of sound within the 630 hertz centered band. 73.9 dB re pW is approximately a 8.75 dB re pW or a 10.6% reduction of the original sound (e.g., sound produced by the plenum fan without a second inlet bell 36 or the flow grid 42, the line $L_1$ in FIG. 5) produced by the plenum fan within the 630 hertz centered band.

A plenum fan with the secondary bell inlet 36 and flow grid 42 is expected to produce 73.9 dB re pW of sound within the 630 hertz centered band as explained above. Combining the individual effects of the secondary inlet bell 36 and the flow grid 42 is expected to reduce the sound produced by the plenum fan in the 630 hertz centered band by 8.75 dB re pW (or a reduction of approximately 10.6%). However, the secondary bell inlet 34 and flow grid 34 in an embodiment synergistically reduce the sound produced by the plenum fan in the 630 hertz centered band to 70.92 dB re pW, which is a reduction of 11.72 dB re pW (or a reduction of approximately 14.18%).

The secondary inlet bell 34 and flow grid 42 synergistically provide a greater sound reduction of approximately 11.72 dB re pW or 14.18% of the sound of the plenum fan in the 630 hertz centered band than the expected reduction of approximately 8.75 dB re pW or 10.6%. As such, the secondary inlet bell 34 and flow grid 42 show synergy as they reduce the largest sound produced by the plenum fan (e.g., the tones produced in the 630 hertz centered band) by a greater amount than expected from combining the individual effects of each component.

It should also be appreciated that the expected reduction of 10.6% is calculated with the individual effects being combining without any loss. However, the expected reduction could be considered to have some losses when being combined. For example, the secondary inlet bell 32 (by itself) may already provide some reduction to the turbulence of the flow into the primary inlet bell in the same manner as the flow grid 42. Thus, it would not be expected that the all of the sound reduction of flow grid 42 (e.g., a reduction of approximately 7.02%) would not be expected when adding the effect of the flow grid 42 to the effect of the secondary inlet bell 32.

Aspects:

Any of aspects 1-11 can be combined with any of aspects 12-19, and any of aspects 1-11 or 12-19 can be combined with aspect 20.

Aspect 1. A centrifugal fan assembly, comprising:

a fan wheel including an axial inlet, the fan wheel radially discharging air;

a primary inlet bell that directs the air into the axial inlet of the fan wheel;

a secondary inlet bell that directs the air towards the primary inlet bell;

a flow grid that guides the air flowing into the secondary inlet bell.

Aspect 2. The centrifugal fan assembly of aspect 1, further comprising:

a cabinet including an air inlet and an air outlet, wherein the fan wheel, the primary inlet bell, and the secondary inlet bell are located within the cabinet, and the secondary inlet bell is affixed to the cabinet.

Aspect 3. The centrifugal fan assembly of either of aspect 2, wherein the flow grid is affixed to one of the secondary inlet bell and the cabinet.

Aspect 4. The centrifugal fan assembly of any of aspects 1-3, further comprising:

a frame for supporting the fan wheel and the primary inlet bell, the fan wheel being rotatably affixed to the frame, and the primary inlet bell being affixed to the frame.

Aspect 5. The centrifugal fan assembly of aspect 4, further comprising:

one or more vibration isolators that support the frame, the one or more vibration isolators being affixed to a cabinet of the centrifugal fan assembly, and the one or more vibration isolators supporting the frame such that the frame is configured to be moveable relative to a cabinet.

Aspect 6. The centrifugal fan assembly of aspect 5, wherein each of the one or more vibration isolators includes a spring that is located between the frame and the cabinet, the spring biasing the frame away from the cabinet.

Aspect 7. The centrifugal fan assembly of any of the aspects 4-6, further comprising:

a driveshaft that rotates the fan wheel, a motor that rotates the driveshaft, the motor being affixed to the frame; and one or more radial bearings that support the driveshaft as it rotates, the one or more radial bearings being affixed to the frame, wherein the fan wheel is rotatably affixed to the frame via the motor, the driveshaft, and the one or more radial bearings.

Aspect 8. The centrifugal fan assembly of any of aspects 1-7, further comprising:

a flexible duct that extends between the primary inlet bell and the secondary inlet bell, the flexible duct being configured to prevent air from passing between the primary inlet bell and the secondary inlet bell.

Aspect 9. The sound reduction assembly of aspect 8, wherein the flexible duct includes a first end and a second end, the second end being opposite to the first end, the first end of the flexible duct being affixed to one of the secondary inlet bell and a cabinet, and the second end of the flexible duct being affixed to one of the primary inlet bell and a frame for the fan wheel.

Aspect 10. The centrifugal fan assembly of any of the aspects 1-9, wherein the flow grid is located outside the cabinet.

Aspect 11. The centrifugal fan assembly of any of the aspects 1-10, wherein the flow grid is concave towards the fan wheel.

Aspect 12. A sound reduction assembly for a centrifugal fan or a centrifugal compressor, comprising:

a primary inlet bell that is configured to be in a fixed position relative to one of a fan wheel and an impeller housing;

a secondary inlet bell that is configured to be in a non-fixed position relative to the primary inlet bell such that the primary inlet bell is independently moveable relative to the secondary inlet bell; and a flow grid that guides air flowing into the one of the fan wheel and the impeller housing, the flow grid being configured to reduce turbulent air flow.

Aspect 13. The sound reduction assembly of aspect 12, further comprising:

a cabinet for the fan wheel, the secondary inlet bell being configured to be in a fixed position relative to the cabinet.

Aspect 14. The sound reduction assembly of either of aspects 13, wherein the flow grid is affixed to one of the secondary inlet bell and the housing.

Aspect 15. The sound reduction assembly of any of aspects 12-14, further comprising:

a frame for supporting the primary inlet bell and the one of the fan wheel and the impeller housing, the one of the fan wheel and the impeller housing being configured to be in a fixed position relative to the frame, and the frame being configured to be in a non-fixed position relative to the secondary inlet bell.

Aspect 16. The sound reduction assembly of aspect 15, wherein the fan wheel is configured to be in a fixed position relative to the frame while still being rotatable.

Aspect 17. The sound reduction assembly of either of aspects 15 or 16, further comprising:

one or more vibration isolators that support the frame, the vibration isolators supporting the frame while allowing the frame to be in the non-fixed position relative to the secondary inlet bell.

Aspect 18. The sound reduction assembly of any of aspects 12-17, further comprising:

a flexible duct located between the primary inlet bell and the secondary inlet bell, the flexible duct being configured to prevent air from flowing between the primary inlet bell and the secondary inlet bell.

Aspect 19. The sound reduction assembly of any of aspects 12-18, wherein the flow grid is concave towards the one of the fan wheel and the impeller housing.

Aspect 20. A method of directing air flowing into a centrifugal fan or a centrifugal compressor, the method comprising:

positioning a primary inlet bell to direct the flow of air into a axial inlet of the centrifugal fan or the centrifugal compressor, the primary inlet bell being in a fixed position relative to the axial inlet;

directing, via a secondary inlet bell, the air flowing into the secondary inlet bell, the secondary inlet bell being in a non-fixed position relative to the primary inlet bell; and guiding, via a flow grid, the air that flows into secondary inlet bell, wherein the flow grid limits a radial and a circumferential movement of the air.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A centrifugal fan assembly, comprising:

a fan wheel including an axial inlet, the fan wheel configured to radially discharge air;

a primary inlet bell that directs the air into the axial inlet of the fan wheel, the primary inlet bell being in a fixed position relative to the axial inlet;

a secondary inlet bell that directs the air towards the primary inlet bell, the secondary inlet bell being in a non-fixed position relative to the primary inlet bell;

a flow grid that guides the air flowing into the secondary inlet bell and configured to reduce turbulence in the air flowing into the secondary inlet bell, the flow grid including a plurality of radial dividers defining separated volumes that reduce radial and circumferential movement of the air flowing through the flow grid; and a flexible duct extending between the primary inlet bell and the secondary inlet bell, the flexible duct configured to prevent air from passing between the primary inlet bell and the secondary inlet bell.

2. The centrifugal fan assembly of claim 1, further comprising:

a cabinet including an air inlet and an air outlet, wherein the fan wheel, the primary inlet bell, and the secondary inlet bell are located within the cabinet, and the secondary inlet bell is affixed to the cabinet.

3. The centrifugal fan assembly of claim 2, wherein the flow grid is affixed to one of the secondary inlet bell and the cabinet.

4. The centrifugal fan assembly of claim 1, further comprising:

a frame for supporting the fan wheel and the primary inlet bell, the fan wheel being rotatably affixed to the frame, and the primary inlet bell being affixed to the frame.

5. The centrifugal fan assembly of claim 4, further comprising:

one or more vibration isolators that support the frame, the one or more vibration isolators being affixed to a cabinet of the centrifugal fan assembly, and the one or more vibration isolators supporting the frame such that the frame is configured to be moveable relative to a cabinet.

6. The centrifugal fan assembly of claim 5, wherein each of the one or more vibration isolators includes a spring that is located between the frame and the cabinet, the spring biasing the frame away from the cabinet.

7. The centrifugal fan assembly of claim 4, further comprising:

a driveshaft that rotates the fan wheel, a motor that rotates the driveshaft, the motor being affixed to the frame; and one or more radial bearings that support the driveshaft as it rotates, the one or more radial bearings being affixed to the frame, wherein the fan wheel is rotatably affixed to the frame via the motor, the driveshaft, and the one or more radial bearings.

8. The centrifugal fan assembly of claim 1, wherein the flexible duct includes a first end and a second end, the second end being opposite to the first end, the first end of the flexible duct being affixed to one of the secondary inlet bell and a cabinet, and the second end of the flexible duct being affixed to one of the primary inlet bell and a frame for the fan wheel.

9. The centrifugal fan assembly of claim 1, wherein the flow grid is located outside the cabinet.

10. The centrifugal fan assembly of claim 1, wherein the flow grid has a concave shape towards the fan wheel.

11. A sound reduction assembly for a centrifugal fan or a centrifugal compressor, comprising:

a primary inlet bell configured in a fixed position relative to one of a fan wheel or an impeller housing, the primary inlet bell configured to direct air into an axial inlet of the one of the fan wheel or the impeller housing;

a secondary inlet bell configured in a non-fixed position relative to the primary inlet bell such that the primary inlet bell is independently moveable relative to the secondary inlet bell, the secondary inlet bell configured to direct the air towards the primary inlet bell;

a flow grid that guides the air flowing into the secondary inlet bell and configured to reduce turbulence in the air flowing into the secondary inlet bell, the flow grid including a plurality of radial dividers defining separated volumes that reduce radial and circumferential movement of the air flowing through the flow grid; and a flexible duct extending between the primary inlet bell and the secondary inlet bell, the flexible duct configured to prevent air from passing between the primary inlet bell and the secondary inlet bell.

12. The sound reduction assembly of claim 11, further comprising:

a cabinet for the fan wheel, the secondary inlet bell being configured to be in a fixed position relative to the cabinet.

13. The sound reduction assembly of claim 12, wherein the flow grid is affixed to one of the secondary inlet bell and the cabinet.

14. The sound reduction assembly of claim 11, further comprising:

a frame for supporting the primary inlet bell and the one of the fan wheel and the impeller housing, the one of the fan wheel and the impeller housing being configured to be in a fixed position relative to the frame, and the frame being configured to be in a non-fixed position relative to the secondary inlet bell.

15. The sound reduction assembly of claim 14, wherein the fan wheel is configured to be in a fixed position relative to the frame while still being rotatable.

16. The sound reduction assembly of claim 14, further comprising:

one or more vibration isolators that support the frame, the vibration isolators supporting the frame while allowing the frame to be in the non-fixed position relative to the secondary inlet bell.

17. The sound reduction assembly of claim 11, wherein the flow grid has a concave shape towards the one of the fan wheel and the impeller housing.

18. A method of directing air flowing into a centrifugal fan or a centrifugal compressor, the method comprising:

positioning a primary inlet bell to direct the flow of air into an axial inlet of one of the centrifugal fan or the centrifugal compressor, the primary inlet bell being in a fixed position relative to the axial inlet;

directing, via a secondary inlet bell, the air flowing into the primary inlet bell, the secondary inlet bell being in a non-fixed position relative to the primary inlet bell;

guiding, via a flow grid, the air that flows into the secondary inlet bell to reduce turbulence in the air flowing into the secondary inlet bell, the flow grid including a plurality of radial dividers defining separated volumes that reduce radial and circumferential movement of the air flowing through the flow grid; and preventing, via a flexible duct extending between the primary inlet bell and the secondary inlet bell, air from passing between the primary inlet bell and the second inlet bell.

* * * * *